United States Patent [19]

Iannucci et al.

[11] 4,034,643

[45] July 12, 1977

[54] BOBBIN DRIVE MECHANISM FOR A ROTARY BRAIDER

[75] Inventors: Vincent Alfonso Iannucci, West Lawn; Rudolf Herbert Haehnel, Reading; Ronald Scheck Schartel, North Whitfield, all of Pa.

[73] Assignee: Rockwell International Corporation, Pittsburgh, Pa.

[21] Appl. No.: 737,220

[22] Filed: Nov. 1, 1976

[51] Int. Cl.[2] ..... D04C 3/06; D04C 3/42

[52] U.S. Cl. ..... 87/48

[58] Field of Search ..... 87/14, 33, 44–48

[56] References Cited

U.S. PATENT DOCUMENTS

| | | | |
|---|---|---|---|
| 958,512 | 5/1910 | LeBlanc | 87/48 |
| 1,059,523 | 4/1913 | Brondel | 87/47 |
| 1,888,477 | 11/1932 | Standish | 87/47 |
| 1,955,206 | 4/1934 | Standish | 87/47 |
| 1,981,377 | 11/1934 | Standish | 87/47 |
| 3,892,161 | 7/1975 | Sokol | 87/48 X |

*Primary Examiner*—John Petrakes

[57] ABSTRACT

A bobbin drive mechanism is for a rotary braider of the type in which a circular array of outer strand supply bobbins and a circular array of inner strand supply bobbins are caused to rotate one array relative to the other. The outer strand supply bobbins are fixedly mounted on a first circular table of the braider, the inner strand supply bobbins are mounted for relative rotational movement about a circular track of the first table and strands from the outer strand supply bobbins are capable of being guided inwardly and outwardly of the track and the inner strand supply bobbins thereon to produce braiding. The bobbin drive mechanism includes a second circular table coaxially aligned with the first table and adapted to rotate relative thereto. A circular array of pairs of shafts corresponds to the array of inner strand supply bobbins and each is mounted for rotation on the second table. The shafts include a planetary gear fixedly mounted thereon in alignment with and engaging a circular gear on the first table to cause rotation of the shaft during relative rotation of the table. A crank is fixedly mounted on an end of each shaft to rotate therewith. A pair of radially extending dogs associated with each inner strand supply bobbin are mounted on the second table and aligned with a slotted fitting of the associated inner strand supply bobbin. Linkage between each dog and its respective crank causes inward and outward movement of the dog during rotation of the shaft. Each of the cranks of the pair of shafts is prepositioned to cause one of the dogs to be in driving engagement with the slotted fitting of the inner strand supply bobbin as the other of the dogs is displaced therefrom to allow the strand from the outer strand supply bobbin to freely pass therebetween.

5 Claims, 4 Drawing Figures

BOBBIN DRIVE MECHANISM FOR A ROTARY BRAIDER

BACKGROUND OF THE INVENTION

1. Field of the Invention.

This invention relates to a bobbin drive mechanism for a rotary braiding machine of the type disclosed in U.S. patent application Ser. No. 727,092, filed Sept. 27, 1976, by Vincent A. Iannucci et al, entitled "Braiding Machine" and assigned to the assignee of this application, which includes a circular array of outer strand supply bobbins which move in one direction, a circular array of inner strand supply bobbins which move in the opposite direction and an oscillating device for directing the outer strands inwardly and outwardly of the inner strand supply bobbins and, more specifically, to a mechanism which causes the inner strand supply bobbins to be rotated without producing interfering contact with the outer strands during braiding.

2. Description of the Prior Art.

There have heretofore been provided a number of braiding machines which are employed to braid a plurality of strands into a completed braided product or a braided jacket for a core member being drawn through the machine. Some of these machines include mechanisms for directing a plurality of strand supply bobbins inwardly and outwardly of each other through elaborate gearing and camming means. The gearing and camming means are quite complicated to manufacture and maintain and tend to limit the speed at which braiding can be accomplished. There are, however, other commonly used types of braiders which include a plurality of inner bobbins and a plurality of outer bobbins which are caused to rotate in opposite directions while the strand from the outer bobbin is directed inwardly and outwardly of the array of inner bobbins to produce the braiding. It is these latter types of machines to which the present invention is directed.

The braiding machine which is generally preferred is the type disclosed in U.S. patent application Ser. No. 727,092, filed on Sept. 27, 1976, which is incorporated herein by reference. This type of machine is capable of providing high speed braiding while employing a large number of strand supply bobbins. The unique guiding means disclosed therein provides a simple and effective means of guiding the strands at higher braiding speeds without causing damage thereto. Additionally, the machine employs an effective means in the form of two rotating tables for establishing opposite rotation of the inner strand supply bobbins and the outer strand supply bobbins while minimizing the overall size of the machine.

Although the machine can be effectively utilized to produce braiding, the reliability of the rotating dog machinery which is employed to drive the inner strand supply bobbins is of some concern. Attempting to dirve the dogs with a belt could result in problems if slippage occurred. The relative positions of the dogs must be predetermined and remain synchronized with the guiding of the outer strand for effective braiding to be accomplished.

SUMMARY OF THE INVENTION

It is, therefore, an object of the present invention to provide a bobbin drive mechanism for a high speed braiding machine which employs a large number of strand supply bobbins.

It is another object to provide a bobbin drive mechanism of the type described which is reliable and is relatively simply to provide and maintain.

These and other objects of the invention are provided in a preferred embodiment thereof which includes a bobbin drive mechanism for a rotary braider of the type in which a circular array of outer strand supply bobbins and a circular array of inner strand supply bobbins are caused to rotate one array relative to the other. The outer strand supply bobbins are fixedly mounted on a first circular table of the braider, the inner strand supply bobbins are mounted for relative rotational movement about a circular track of the first table and strands from the outer strand supply bobbins are capable of being guided inwardly and outwardly of the track and the inner strand supply bobbins thereon to produce braiding. The bobbin drive mechanism includes a second circular table coaxially aligned with the first table and adapted to rotate relative thereto. A circular array of pairs of shafts corresponds to the array of inner strand supply bobbins and each is mounted for rotation on the second table. The shafts include a planetary gear fixedly mounted thereon in alignment with and engaging a circular gear on the first table to cause rotation of the shaft during relative rotation of the table. A crank is fixedly mounted on an end of each shaft to rotate therewith. A pair of radially extending dogs associated with each inner strand supply bobbin are mounted on the second table and aligned with slot means of the associated inner strand supply bobbin. Linkage between each dog and its respective crank causes inward and outward movement of the dog during rotation of the shaft. Each of the cranks of the pair of shafts is prepositioned to cause one of the dogs to be in driving engagement with the slot means of the inner strand supply bobbin as the other of the dogs is displaced therefrom to allow the strand from the outer strand supply bobbin to freely pass therebetween.

DETAILED DESCRIPTION OF THE PREFERRED EMBODIMENT

Figure 1:
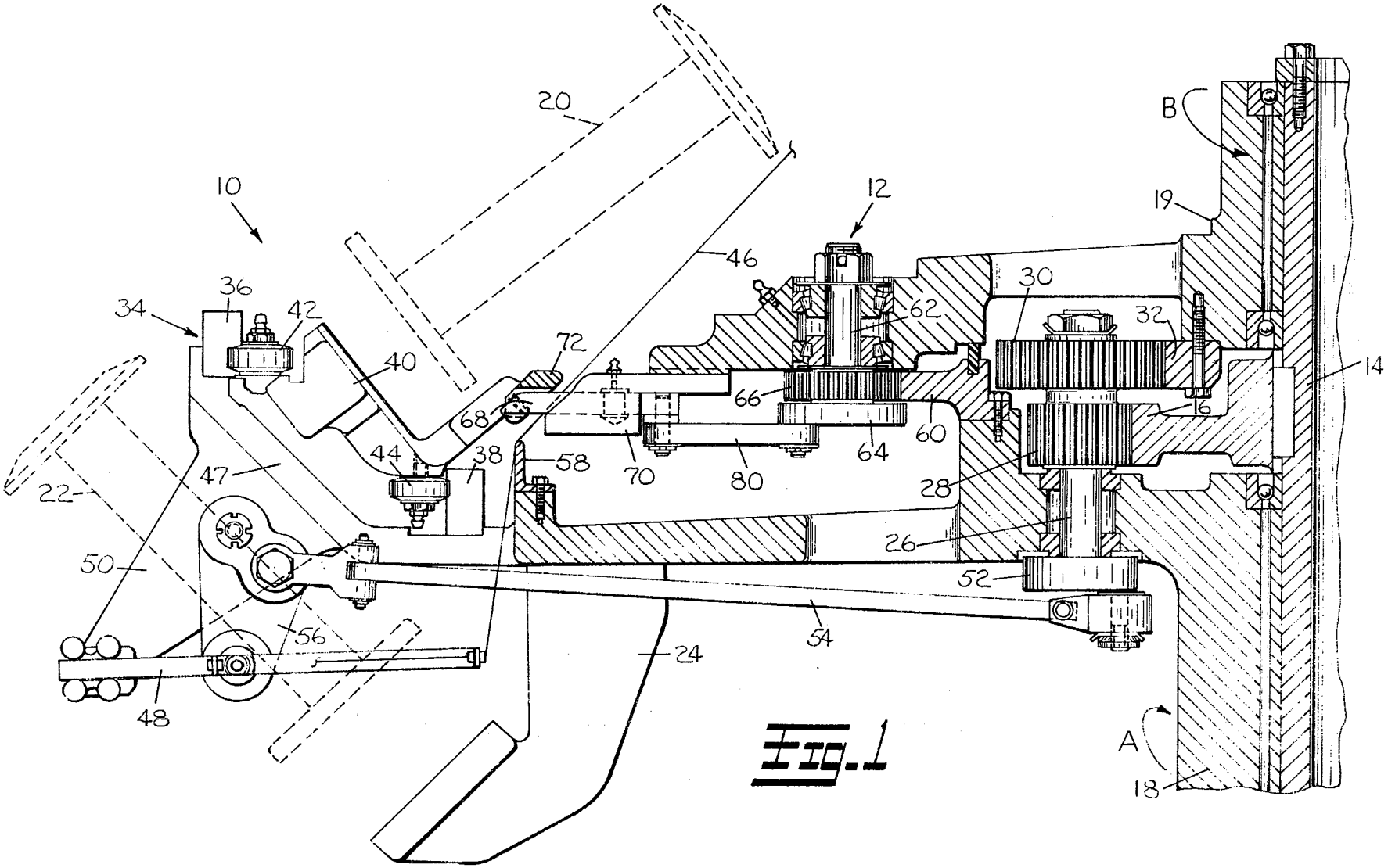
FIG. 1 is a fragmentary, sectional side view of the braiding machine including various features of the invention.

As seen in FIG. 1, a braiding machine 10 is of the type generally disclosed in U.S. patent application Ser. No. 727,092, filed on Sept. 27, 1976, which has been altered to include a preferred bobbin drive mechanism 12 of the present invention. The braiding machine 10 includes a tubular member 14 through which a hose or similar work product (not shown) is drawn by associated machinery at a predetermined rate during braiding. The tubular member 14 is stationary and includes a stationary sun gear 16 mounted at an intermediate portion thereof. A first rotatable table 18 is mounted on one side of the sun gear 16 on the tubular member 14.

As disclosed in the above cited application, the basic braiding machine 10 includes a circular array of inner strand supply bobbins an a concentric circular array of outer strand supply bobbins although only one bobbin of each array 20 and 22, respectively, is shown in phantom in FIG. 1. It should be understood by one skilled in the art that various elements of the machine which will be described are associated with each of the bobbins in the braiding machine 10 although, for simplification in the figures, only one such element might be shown. Each of the supply bobbins and associated strand controlled mechanism relating thereto are generally of the type disclosed in U.S. patent application Ser. No. 679,763, "Strand Carrier For A Strand Fabricating Machine", filed Apr. 23, 1976, by R. H. Haehnel et al and assigned to the assignee of this application. This type of mounted and strand control mechanism allows the strand to be drawn from its respective bobbin under tension and restricts rotation of the bobbin accordingly. A motor (not shown) is provided the machine 10 to provide basic powered rotation of the table 18 as generally indicated by the arrow A.

For each outer strand supply bobbin 22 which is rigidly supported on a support bracket 24 there is a rotatably mounted shaft 26 extending through the table 18. The shafts 26 are parallel with the tubular member 14 and are disbursed in a concentric circular array thereabout. A planetary gear 28 intermediately disposed on the shaft 26 is aligned with and engages the stationary sun gear 16. Rotation of the first table 18 causes the planetary gear 28 to act on the stationary sun gear 16 to produce rotation of the shaft 26. A larger gear 30 is rigidly mounted on an upper end of the shaft 26 and is aligned with and engages a circular drive gear 32 of the second table 19. Although each shaft 26 will tend to move clockwise (when viewed from above) about the tubular member 14, the rotation imparted to the larger gear 30 will act on the second table 19 to cause it to rotate counter-clockwise as indicated by the arrow B.

To provide the basic relative movement between the bobbins required for braiding it is essential for the outer bobbins to move circumferentially relative to the inner bobbins. The outer bobbins are rigidly mounted on the first table 18 by the support structure 24 while the inner bobbins are supported on the first table 18 but are capable of revolving thereon about the tubular member 14 relative to the outer bobbins. Accordingly, the first table 18 includes a circular track element 34 near its outer periphery and includes a pair of tracks 36 and 38 which are adapted to receive an inner strand supply bobbin carrier 40 therebetween. The carrier 40 employs two sets of wheels 42 and 44 (only one of each set of two or more wheels is shown in FIG. 1) which are respectively received within the tracks 36 and 38. Accordingly, each inner strand supply bobbin 20 which is secured to its respective inner strand supply bobbin carrier 40 is mounted on the table 18 but is free to move relative thereto along the track elements 34.

To produce the desired braiding pattern, the outer strand 46 must be directed along a slot 47 inwardly and outwardly of the track element 34 and the inner strand supply bobbins 20. Guiding of the outer strand 46 is accomplished by the oscillation of a strand guide arm 48 which is pivotally mounted to a support bracket 50 of the first table 18. The oscillating motion is produced by a crank 52 which is fixedly mounted on an end of each shaft 26 to directly correspond to the relative motion between the tables 18 and 19. A connecting rod 54 extends from the pin of the crank 52 to a pivoting lever 56 which is also mounted on the support bracket 50. The lever 56, in turn, acts on the guide arm 48.

Although the resulting path of the outer strand 46 relative the inner strand suply bobbins 20 is fully disclosed in the above cited application, it is sufficient for the purposes of the present invention to unerstand that each strand 46 is directed to be positioned outwardly of two inner stand supply bobbins 20 and then inwardly of the next two inner strand supply bobbins 20 as they pass thereby. Throughout the time the strand 46 is inwardly of the bobbins 20, it is held against a strand limiting guide 58 at the inward end of the slot 47. With the strand 46 so located, the carrier drive mechanism 12 is capable of driving the inner strand supply bobbins 20 by the strand 46, in a manner which will be explained in detail hereinbelow, while avoiding all contact with the strand which would otherwise interfere with braiding.

Figures 2, 3, 4:
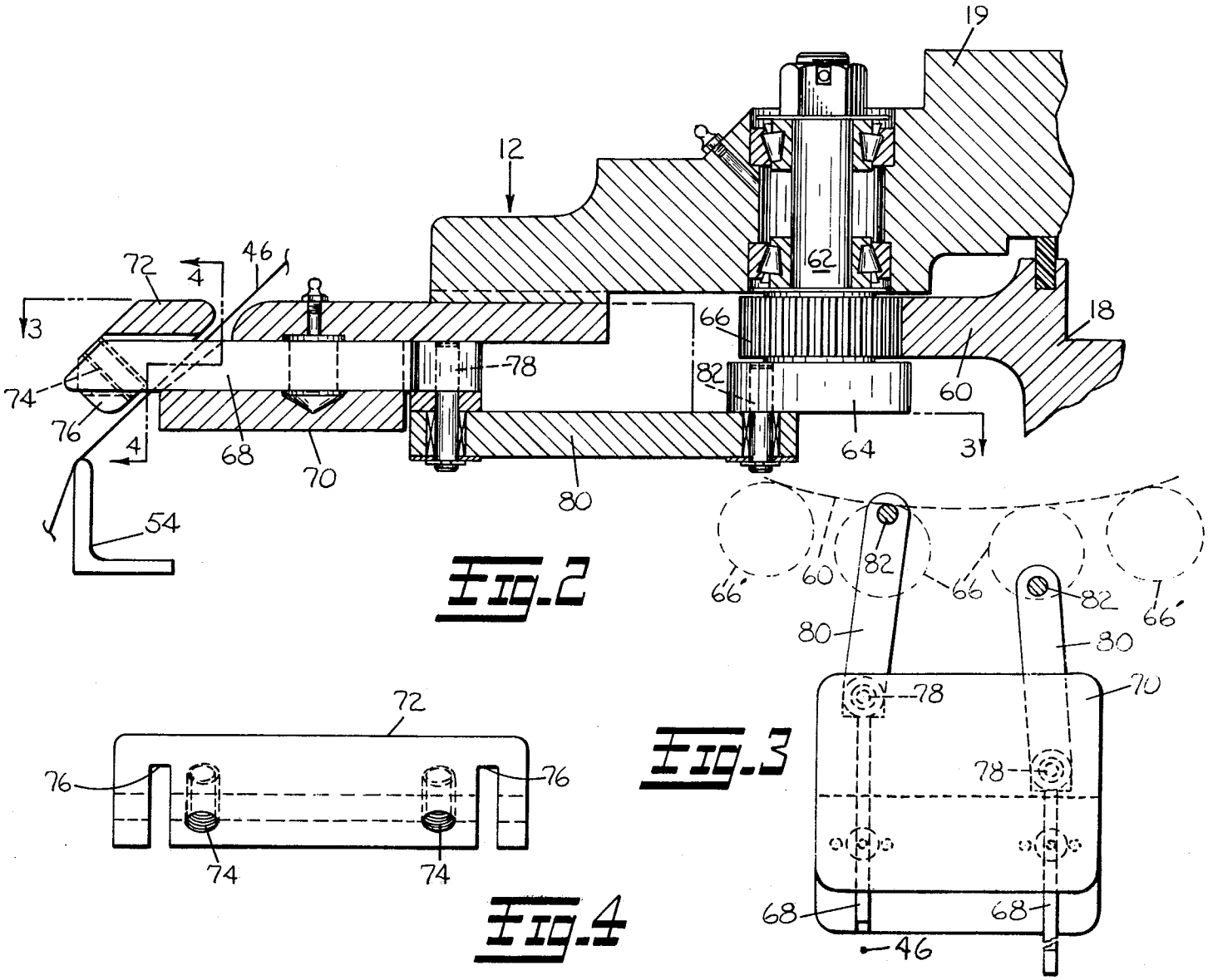
FIG. 2 is an enlarged sectional view of the preferred bobbin drive mechanism as generally shown in FIG. 1.
FIG. 3 is a view of the bobbin drive mechanism as generally seen along line 3—3 of FIG. 2.
FIG. 4 is a view of the portion of the preferred mechanism mounted on the inner strand supply bobbin as seen along line 4—4 of FIG. 2.

Referring to FIGS. 1, 2 and 3, it can be seen that each bobbin drive mechanism 12 includes the second table 19 for support of the various elements of the mechanism 12 relating to its particular inner strand supply bobbin 20. Also included in common with all the bobbin drive mechanisms 12, is a circular gear 60 which is rigidly mounted on the circular table 18 for rotation therewith. For each bobbin drive mechanism 12 which corresponds to an inner strand supply bobbin 20, there is provided a pair of shafts 62 rotatably mounted on the table 19. Each shaft 62 includes a planetary gear 66 at its intermediate portion which is aligned with and engages the circular gear 60 to produce rotation of the shaft 62 when relative motion exists between tables 18 and 19. A crank element 64 is rigidly secured to one end of the shaft 62 so that it too will rotate with the shaft 62 during relative motion.

It is the purpose of a pair of shafts thus described to provide a basic oscillating motion for each of a pair of dogs 68 which cooperate to provide driving motion for their associated inner strand supply bobbin 20. The pair of dogs 68 are mounted in a support structure 70 at the periphery of the second table 19 in general alignment with the inner strand supply bobbin carrier 40. The dogs 68 extend generally radially toward the carrier 40 and are parallel one with the other. The carrier 40 is provided with a slotted fitting 72 for receipt of the dogs 68. The slotted fitting 72, which is best seen in FIG. 4, includes threaded holes 74 to facilitate its being secured to the carrier 40 by bolts (not shown). The slotted fitting 72 includes a pair of spaced slots 76 aligned with and adapted to receive therein the pair of dogs 68. When either dog 68 is received within its slot 76 it is capable of applying force in a circumferential direction to the fitting 72 to produce the required movement of the carrier 40 and the bobbin 20 along the track element 34. The basic concept of oscillation of the dogs 68 which allows the outer strand 46 to pass thereby while till producing the required movement of the bobbin 20 is known in the art. Specifically, it is essential for at least one of the dogs 68 to be received within its slot 76 at all times and for each of the dogs 68 to be withdrawn from its slot 76 and adequately displaced from the slotted fitting 72 as it passes by the inwardly disposed outer strand 46.

Accordingly, the dogs 68 are mounted for inward and outward movement and are to be timed for alternating contact with the slotted fitting 72. The inward end of each dog 68 includes a pin 78 which receives one end of a linkage 80 while the other end of the linkage 80 receives a pin 82 of the crank 64. The initial positions of the shafts 62 are such that when one of the pins 82 is disposed inwardly, the pin 82 of the outer crank 64 is outwardly disposed. Accordingly, the cranks 64 are angularly oriented with the pins 82 thereof being 180° apart. The actual timing of rotation for each shaft 62 is determined by the size and gearing of each of the circular gear 60 and the planetary gear 66. One skilled in the art should be able to select proper parameters, including the space between the dogs 68, to ensure that the bobbin drive mechanism 12 is properly timed to coincide with the guiding of the outer strand 46 by the strand guide arm 48.

Specifically, as the outer strand 46 approaches the first dog 68 (at the right of FIG. 3), it will be withdrawn from its slot 76 and the second dog 68 (at the left) will be inserted in its slot 76 to drive the bobbin 20. As the strand 46 continues to move relatively to the left to the position generally shown in FIG. 3, the first dog 68 will have been repositioned inwardly of the slot 76 to drive the bobbin 20 and the second dog 68 will have been withdrawn to prevent contact with the strand 46. It should be clear that this alternating contact by the dogs 68 with the slotted fitting 72 will continue each time the strand 46 passes the bobbin 20 even though it is only necessary at those times during braiding when the strand guide arm 48 is positioning the strand 46 inwardly of the bobbin 20.

As indicated in FIG. 3, there are shown gears 66' adjacent the gears 66. The gears 66' are included to show the general spacing of adjacent bobbin drive mechanisms 12 relative the one primarily shown. It should be clear that the timing for these adjacent bobbin drive mechanisms 12 will be governed in a manner similar to that described hereinabove but that the actual position of the pins 82 of the cranks 64 will have to be determined according to the general distance between the inner strand supply bobbins 20.

Although the embodiment described hereinabove is the preferred, it should be understood that various alterations can be made thereto without departing from the scope of the invention as claimed.

What is claimed is:

1. A bobbin drive mechanism for a rotary braider of the type in which a circular array of outer strand supply bobbins and a circular array of inner strand supply bobbins are caused to rotate one array relative to the other, said outer strand supply bobbins being fixedly mounted on a first circular table of said braider, said inner strand supply bobbins being mounted for relative rotational movement about a circular track of said first table, and strands from the outer strand supply bobbins being capable of being guided inwardly and outwardly of said track and said inner strand supply bobbins thereon to produce braiding, said bobbin drive mechanism comprising:

a second circular table coaxially aligned with said first table and adapted to rotate relative thereto;

a circular gear mounted on said first table;

a circular array of pairs of shafts corresponding to said array of inner strand supply bobbins being mounted for rotation on said second table;

each said shaft being adjacent said circular gear and having a planetary gear fixedly mounted thereon in alignment with and engaging said circular gear to cause rotation of said shaft during said relative rotation of said first and said second tables;

a crank fixedly mounted on an end of said each of said shafts to rotate therewith;

a pair of radially extending dogs associated with each said inner strand supply bobbin being mounted on said second table and aligned with slot means of said associated inner strand supply bobbin;

linkage means between each said dog and a respective one of said cranks to cause inward and outward movement of said dog during rotation of said shaft; and each of said cranks of said pair of shafts being prepositioned to cause one of said pair of said dogs to be in driving engagement with said slot means of said inner strand supply bobbin as the other of said pair of said dogs is displaced therefrom to allow said strands from said outer strand supply bobbin to freely pass therebetween.

2. The bobbin drive mechanism as set forth in claim 1, wherein said linkage means includes a connecting link having a first end which is pivotally connected to a pin of said crank and a second end which is pivotally joined to an end of said dog which is remote from said slot means.

3. The bobbin drive mechanism as set forth in claim 2, wherein said each of said shafts is parallel with an axis of rotation of said tables and said dogs and said connecting links generally lie in a plane which is perpendicular to said axis.

4. The bobbin drive mechanism as set forth in claim 3, wherein said planetary gear is mounted on said shaft between said second table and said crank.

5. The bobbin drive mechanism as set forth in claim 1, wherein each said inner strand supply bobbin is mounted on a bobbin carrier which is mounted on said circular track and said slot means includes a fitting which is fixedly secured to said bobbin carrier and includes a pair of circumferential spaced slots respectively aligned with said pair of said dogs.

* * * * *